US007149436B2

(12) United States Patent
Sugiura et al.

(10) Patent No.: US 7,149,436 B2
(45) Date of Patent: Dec. 12, 2006

(54) MODE INFORMATION CONVERSION DEVICE, IMAGE FORMING DEVICE AND IMAGE FORMING SYSTEM

(75) Inventors: Hiroshi Sugiura, Hoi-gun (JP); Eiichi Yoshida, Toyokawa (JP); Shoji Imaizumi, Shinshiro (JP); Hiroshi Iwamoto, Toyohashi (JP); Masaaki Saka, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 175 days.

(21) Appl. No.: 11/019,592

(22) Filed: Dec. 23, 2004

(65) Prior Publication Data

US 2006/0093380 A1 May 4, 2006

(30) Foreign Application Priority Data

Nov. 4, 2004 (JP) ..... 2004-320665

(51) Int. Cl.
*G03G 15/00* (2006.01)

(52) U.S. Cl. ..... 399/8

(58) Field of Classification Search ..... None
See application file for complete search history.

(56) References Cited

U.S. PATENT DOCUMENTS

2003/0112292 A1* 6/2003 Lee ..... 347/41
2003/0231342 A1 12/2003 Kurohata et al.

FOREIGN PATENT DOCUMENTS

JP 11-180009 A 7/1999
JP 2000-206836 A 7/2000
JP 2001-236183 A 8/2001
JP 2002-19244 A 1/2002
JP 2004-017339 A 1/2004

OTHER PUBLICATIONS

Office Action issued in priority application on Jun. 6, 2006, and translation thereof.

* cited by examiner

*Primary Examiner*—Vincent Q. Nguyen
(74) *Attorney, Agent, or Firm*—Buchanan Ingersoll & Rooney PC

(57) ABSTRACT

A mode information conversion device connected to a terminal and an image forming device which performs a printing operation. The mode information conversion device including a unit for receiving first mode information transmitted from the terminal, in which a user request to the image forming device is reflected; a unit for acquiring second mode information to be peculiarly used in the image forming device; a unit for registering the first and second mode information so as to be previously related to each other; a unit for converting the first mode information to the second mode information by reading the second mode information related to the first mode information on the mode information registering unit upon receiving the first mode information; and a unit for transmitting the second mode information acquired by conversion to the image forming device which is a print output destination based on the user request.

18 Claims, 8 Drawing Sheets

*Fig.3*

| | FIRST MODE INFORMATION | SECOND MODE INFORMATION | | |
|---|---|---|---|---|
| | | FIRST IMAGE FORMING DEVICE | SECOND IMAGE FORMING DEVICE | THIRD IMAGE FORMING DEVICE |
| SHEET TYPE | Super Paper (100g/m2) | HEAVY PAPER 1 | STANDARD PAPER | GLAZED PAPER |
| | Normal Paper (64g/m2) | STANDARD PAPER | STANDARD PAPER | THIN PAPER |
| SHEET SIZE | | | | |
| | DEFAULT CHINESE PAPER (270×390) | KAI 8 | ATYPICAL SHEET (270×390) | KAI 8 (2) |
| | DEFAULT CHINESE PAPER (195×270) | KAI 16 | ATYPICAL SHEET (195×270) | KAI 16 (2) |
| | | | | |
| OTHERS | MAGAZINE BINDING | MAGAZINE BINDING | BOOKLET | — |
| | SAVING PRINT | 2 in 1 | 2 up | 2 in 1 |
| | STAPLE | — | CORNER STAPLE | ONE POINT STAPLE |

MODE INFORMATION CONVERSION DEVICE, IMAGE FORMING DEVICE AND IMAGE FORMING SYSTEM

This application is based on application No. 2004-320665 filed in Japan, the contents of which is hereby incorporated by reference.

BACKGROUND OF THE INVENTION

1. Field of the Invention

The present invention relates to a mode information conversion device, an image forming device and an image forming system.

2. Description of the Background Art

Recently, a monochrome MFP (Multifunction Peripheral) has been changed to a color MFP at an accelerated pace in an office and the like along with development of the color MFP. When it is changed, a sheet used as standard paper in the monochrome MFP is defined as another type of sheet such as heavy paper in the color MFP in some cases. In addition, according to a sheet referred to as "kai 8" used in China in general, for example, there are many different sheet sizes even in the same name. However, since one definite size is set for one name in general in the MFP, the sheet of "kai 8" cannot be automatically corresponded. As a result, it is necessary to manually reset the definition of the conventional definite size when it is changed to the color MFP.

The above could be generated in a case where a new MFP is added as well as the case where the monochrome MFP is changed to the color MFP. That is, there is a demand for technique which can assimilate a setting name such as a function name, a sheet name and the like peculiar to each MFP, among different MFPs.

Regarding the above technique, Japanese Patent Laid-open Publication No. 2002-19244 discloses the technique which can grasp sheet sizes/sheet types available in all image forming devices on the network at the same time to simplify a sheet selecting operation for each image forming device, for example. In addition, Japanese Patent Laid-open Publication No. 2000-206836 discloses the technique which starts an operation when the specified sheet size and sheet type coincide while a connected copying operation is performed, for example.

However, according to the technique disclosed in the above patent documents 1 and 2, for example, there is a case where a sheet having a basic weight of 100 g/m$^2$ is set as heavy paper in one image forming device and it is set as standard paper in the other image forming device, so that it is necessary for a user to specify an appropriate sheet type for each device. If such specification of the sheet type is not performed, different sheets are used due to the same specification set on the two image forming devices, and a copy error could be generated.

SUMMARY OF THE INVENTION

The present invention was made in view of the above technical problems, and it is an object of the present invention to provide a mode information conversion device, an image forming device, an image forming system, a method of converting a mode information and a recording medium recording an mode information conversion program which can assimilate a set name peculiar to each image forming device, implement operational simplicity, and avoid generation of a copy error.

In an aspect of the present invention, there is provided a mode information conversion device connected to a terminal and an image forming device which performs a printing operation based on predetermined job data such that data can be transmitted and received among them. The mode information conversion device comprises: a first receiving unit for receiving first mode information transmitted from the terminal, in which a user request to the image forming device is reflected; an acquiring unit for acquiring second mode information to be peculiarly used in the image forming device; a mode information registering unit for registering the first and second mode information so as to be previously related to each other; a first mode information converting unit for converting the first mode information to the second mode information by reading the second mode information related to the first mode information on the mode information registering unit when the first mode information is received; and a first transmitting unit for transmitting the second mode information acquired by conversion of the first mode information to the image forming device which is a print output destination based on the user request.

The mode information registering unit may register the second mode information peculiar to the plurality of image forming devices so as to be related to the first mode information.

The mode information conversion device may further comprise: a second receiving unit for receiving the second mode information transmitted from the image forming device when a state which cannot carry out a user request regarding the second mode information in the image forming device occurs; a second mode information converting unit for converting the second mode information to the first mode information by reading the first mode information related to the second mode information on the registering unit when the second mode information is received; and a second transmitting unit for transmitting the first mode information acquired by conversion of the first mode information to the terminal.

The first and second mode information may comprise information for specifying a sheet type or a sheet size. Also, the first and second mode information may comprise information for specifying a function setting condition to be used in the image forming device.

In another aspect of the present invention, there is provided an image forming device connected to a terminal such that data can be transmitted and received between them and performing a printing operation based on predetermined job data, wherein the mode information conversion device according to claim 1 is constituted as a part of the image forming device.

Furthermore, in another aspect of the present invention, there is provided an image forming system in which a terminal and an image forming device which performs a printing operation based on predetermined job data are connected to each other such that data can be transmitted and received among them, said image forming system is provided with a mode information conversion device comprising: a first receiving unit for receiving first mode information transmitted from the terminal, in which a user request to the image forming device is reflected; an acquiring unit for acquiring second mode information to be peculiarly used in the image forming device; a mode information registering unit for registering the first and second mode information so as to be previously related to each other; a first mode information converting unit for converting the first mode information to the second mode information by reading the second mode information related to the first mode information on the mode information registering unit when the first mode information is received; and a first transmitting unit for transmitting the second mode information acquired by conversion of the first mode information to the image forming device which is a print output destination based on the user request.

The image forming devices may be connected to the terminal and the mode information conversion device such that data can be transmitted and received among them, and the terminal may comprise setting unit for setting the plurality of image forming devices as print output destinations, and the mode information conversion device may convert the first mode information received from the terminal to the plurality of second mode information related to the first mode information, when the plurality of image forming devices are set by the terminal as the print output destinations, and transmit the second mode information to the plurality of image forming devices as the print output destinations.

The mode information conversion device may further comprise: a second receiving unit for receiving the second mode information transmitted from the image forming device when a state which cannot carry out a user request regarding the second mode information in the respective image forming devices occurs; a second mode information converting unit for converting the second mode information to the first mode information by reading the first mode information related to the second mode information on the registering unit when the second mode information is received; and a second transmitting unit for transmitting the first mode information acquired by conversion of the second mode information to the terminal.

The mode information conversion device may be constituted as a part of any one of the image forming devices. Also, the first and second mode information may comprise information for specifying a sheet type or a sheet size.

The first and second mode information may comprise information for specifying a function setting condition to be used in the respective image forming devices.

At least one image forming device may comprise a scanning unit for creating job data based on an original manuscript and have a function of instructing another image forming device to print out based on the job data created by the scanning unit, and the mode information conversion device may receive the second mode information from the image forming device comprising the scanning unit, convert the second mode information to second mode information related to common first mode information regarding another image forming device and then, transmit the second mode information to another image forming device when the printout based on the job data created by the scanning unit is instructed.

In another aspect of the present invention, there is provided a method of converting mode information between a terminal and an image forming device which performs a printing operation based on predetermined job data, the method comprising steps of: receiving first mode information transmitted from the terminal, in which a user request to the image forming device is reflected; acquiring second mode information to be peculiarly used in the image forming device; registering the first and second mode information so as to be previously related to each other; converting the first mode information to the second mode information by reading the second mode information related to the first mode information when the first mode information is received; and transmitting the second mode information acquired by conversion of the first mode information to the image forming device which is a print output destination based on the user request.

In another aspect of the present invention, there is provided a computer program product for use in a mode information conversion device connected to a terminal and an image forming device which performs a printing operation based on predetermined job data such that data can be transmitted and received among them, the computer program product includes codes on a computer readable medium, comprising: a code for receiving first mode information transmitted from the terminal, in which a user request to the image forming device is reflected; a code for acquiring second mode information to be peculiarly used in the image forming device; a code for registering the first and second mode information so as to be previously related to each other; a code for converting the first mode information to the second mode information by reading the second mode information related to the first mode information on the mode information registering unit when the first mode information is received; and a code for transmitting the second mode information acquired by conversion of the first mode information to the image forming device which is a print output destination based on the user request.

In another aspect of the present invention, there is provided a computer-readable recording medium storing a program for converting mode information in a mode information conversion device connected to a terminal and an image forming device which performs a printing operation based on predetermined job data such that data can be transmitted and received among them, the computer program product includes codes on a computer readable medium, the mode information conversion program including the following steps to be executed by the computer: a step for receiving first mode information transmitted from the terminal, in which a user request to the image forming device is reflected; a step for acquiring second mode information to be peculiarly used in the image forming device; a step for registering the first and second mode information so as to be previously related to each other; a step for converting the first mode information to the second mode information by reading the second mode information related to the first mode information on the mode information registering unit when the first mode information is received; and a step for transmitting the second mode information acquired by conversion of the first mode information to the image forming device which is a print output destination based on the user request.

BRIEF DESCRIPTION OF THE DRAWINGS

FIG. 3 is a view showing a mode information management table stored in the mode information conversion device;

DESCRIPTION OF THE PREFERRED EMBODIMENTS

An embodiment of the present invention will be described with reference to the accompanying drawings hereinafter.

Figure 1:
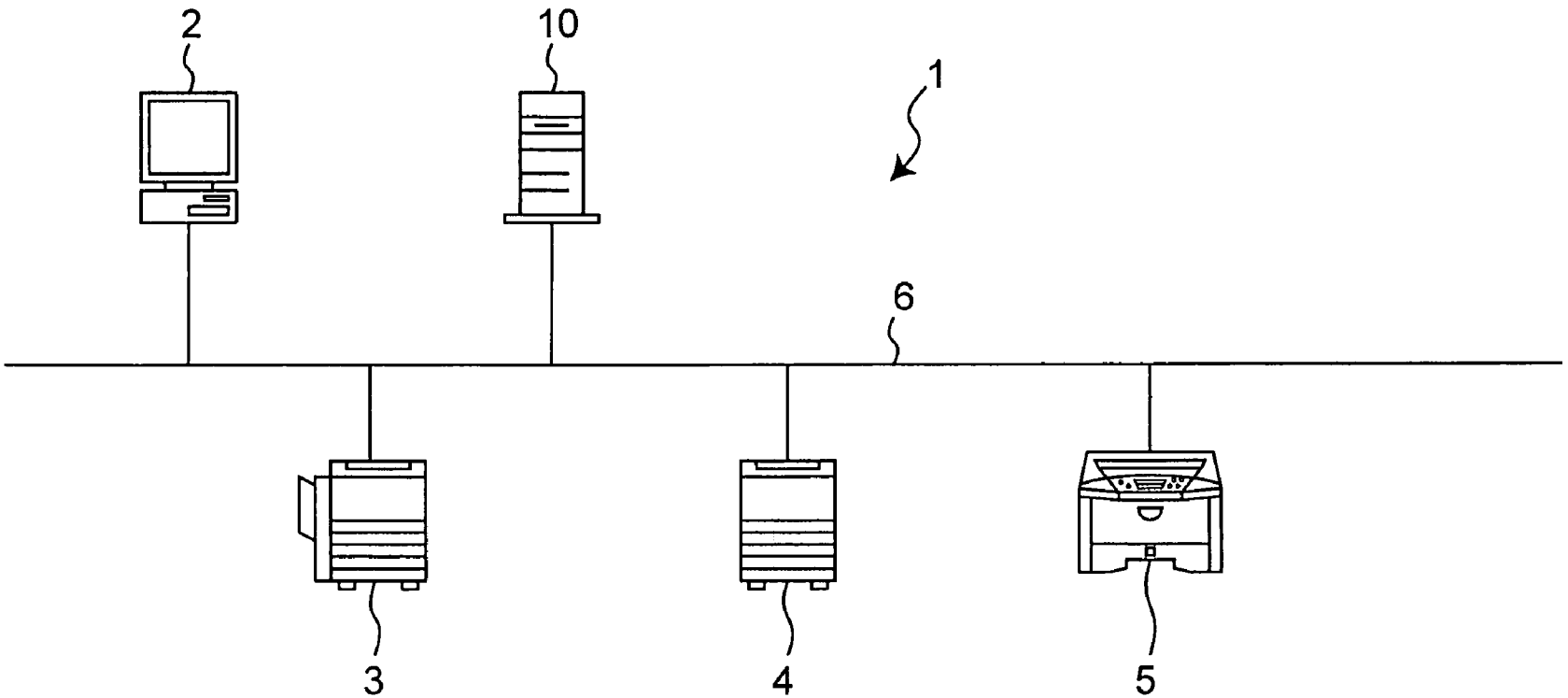
FIG. 1 is a view showing a constitution of an image forming system comprising a mode information conversion device according to an embodiment of the present invention.

FIG. 1 is a view showing an image forming system which is constituted on the network incorporating a mode information conversion device according to this embodiment of the present invention. The image forming system 1 comprises a client PC 2, first, second and third image forming devices 3, 4 and 5 having printing functions of outputting job data transmitted from the client PC 2, and a mode information conversion device 10. They are connected to each other through a network bus 6 to transmit or receive data. According to this embodiment, a general-purpose computer is employed as the client PC 2, a general-purpose MFP comprising a plurality of trays is employed as the first and second image forming devices 3 and 4, and a general-purpose printer is employed as the third image forming device.

A printer driver program (referred to as the printer driver, hereinafter) which can set various kinds of printing conditions and control the printer is installed in the client PC 2 in order to recognize the image forming devices 3, 4 and 5 which are output destinations of the job data. When printing is executed in the image forming system 1, the printer driver is activated in the client PC 2 in general. On this printer driver, a user sets (mode sets) sheet conditions such as a sheet type, a sheet size and the like and printing conditions comprising function setting conditions such as whether to staple or not, to print both sides or one side and the like, to command printing execution. When the printer driver commands execution of the printing, the job data and mode information showing the printing condition in which a user request is reflected is transmitted. In addition, on the printer driver, one or more image forming devices can be set as the output destinations of the job data when the printing execution is commanded. When the plurality of image forming devices are set, the same job data can be printed by the plurality of image forming devices in parallel (so-called tandem printing).

On the other hand, each of the image forming devices 3, 4 and 5 receives the job data and the mode information transmitted from the outside, and prints the job data under the printing conditions set based on the mode information.

As described above, there are some cases where even when the same mode is set, the mode information corresponding to the mode is different among the plurality of image forming devices 3, 4 and 5, that is, a sheet having basic weight of 100 g/m$^2$ is set as "heavy paper" in the mode information in one image forming device while it is set as "standard paper" in the mode information in the other image forming device, for example. Therefore, it is necessary to set appropriate mode information each image forming device in the conventional example. Meanwhile, according to this embodiment, in order to resolve this, according to a command for executing the printing, the mode information (first mode information) transmitted with the job data from the client PC 2 is received by the mode information conversion device 10 once, and converted to mode information (second mode information) which is appropriate to each of the image forming devices 3, 4 and 5, and then transmitted to the image forming devices 3, 4 and 5. A constitution of the mode information conversion device 10 and its mode information conversion process will be described hereinafter.

Figure 2:
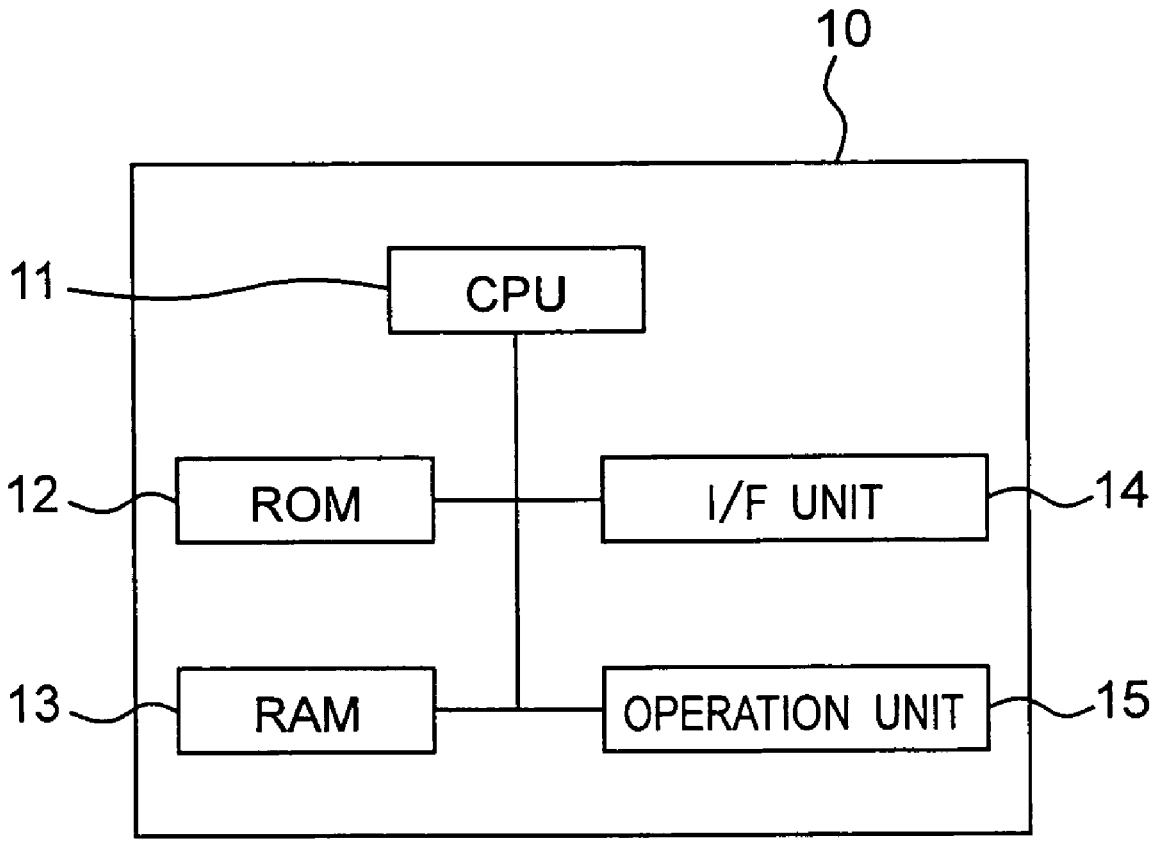
FIG. 2 is a block diagram schematically showing an inner constitution of the mode information conversion device.

FIG. 2 is a block diagram schematically showing an internal constitution of the mode information conversion device 10. The mode information conversion device 10 comprises a CPU 11 for sequentially controlling each unit in the mode information conversion device 10, a ROM 12 for recording a program for the sequential control, a RAM 13 which is used as a working area required for the program or stores a mode information management table referred to at the time of mode information conversion process, an interface unit (I/F in the figure) 14 for transmitting and receiving various data among the client PC 2 and the first, second and third image forming devices 3, 4 and 5, and an operation unit 15 for operating various kinds of setting operations, as its fundamental constitution.

FIG. 3 is a view showing the mode information management table stored in the RAM 13 in the mode information conversion device 10, in which the first and second mode information are registered. In this mode information management table, the mode information (first mode information) used in the client PC 2 and the mode information (second mode information) used in the first, second and third image forming devices 3, 4 and 5 are registered so as to be related to each other regarding a sheet type, a sheet size and the like. For example, according to an example shown in FIG. 3, one sheet type "Super Paper (100 g/m2)" in the first mode information corresponds to the second mode information such as "Heavy Paper 1" in the first image forming device 3, "Standard Paper" in the second image forming device 4 and "Glazed Paper" in the third image forming device 5 is registered. In addition, one sheet size "Default Chinese Paper (270×390)" in the first mode information corresponds to the second mode information such as "Kai 8" in the first image forming device 3, "Atypical size (270×390)" in the second image forming device 4 and "Kai 8 (2)" in the third image forming device 5 is registered. Furthermore, apart from the sheet conditions, one function setting condition "Magazine Binding" in the first mode information corresponds to the second mode information such as "Magazine Binding" in the first image forming device 3 and "Booklet" in the second image forming device 4 is registered. Since the third image forming device 5 does not have a function corresponding to the "Magazine Binding", the second mode information is not registered therein.

When the mode information conversion device 10 is connected to the network, it is necessary to set the above mode information management table in the mode information conversion device 10, and when a new image forming device is connected to the network, for example, it is necessary to additionally register the second mode information to be used in the new image forming device so as to correspond to the first mode information which has been already registered in the mode information management table. In this case, the setting of the mode information management table and the additional registration of the second mode information may be performed from the operation unit 15 of the mode information conversion device 10 or by transmitting an information for the setting and the additional registration to the mode information conversion device 10 after they are set in the client PC 2.

In addition, when the second mode information is additionally registered, information of MIB (Management Information Base) is acquired by using SNMP (Simple Network Management Protocol) and the like and the acquired information such as "Standard Paper" and the like as the second mode information, may be related to the first mode information such as the already registered "Super Paper (100 b/m$^2$), so that it is not necessary to input the second mode information manually all the time. Furthermore, in a case where the type of the sheet obtained from one image forming device is only one kind, when the "Super Paper (100 g/m$^2$)" is registered in the mode management table as the first mode information, an automatic relating operation may be performed without performing an operation relating the second mode information to the first mode information.

Figure 4:
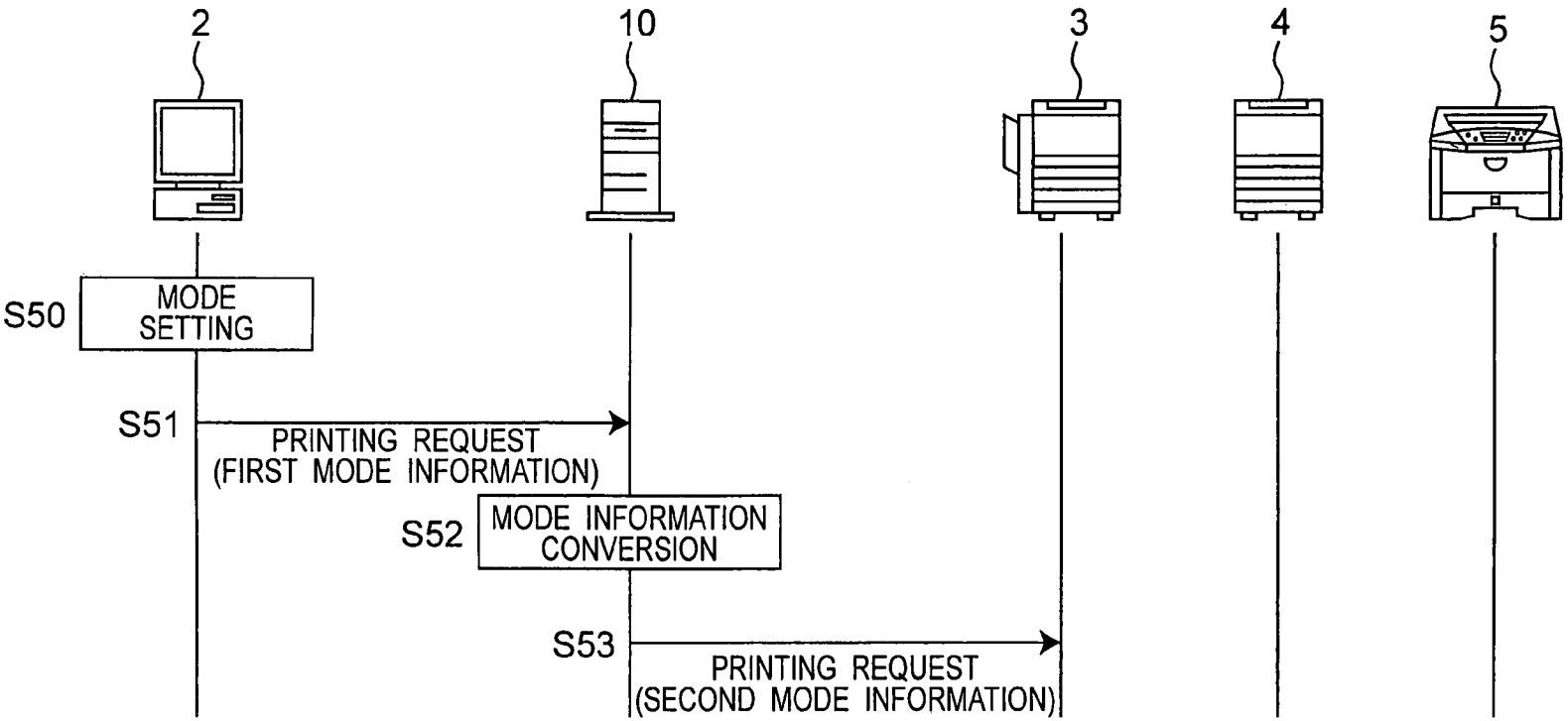
FIG. 4 is a view showing a flow of a mode information conversion process using the mode information conversion device in the image forming system.

FIG. 4 is a view showing a flow of a mode information conversion process using the mode information conversion device 10 in the image forming system 1. Although an example in which the first image forming device 3 is set as a print output destination here, even when another image forming device is set, the flow of the mode information management process is the same.

First, a mode is set based on the first mode information showing various printing conditions on the printer driver of the client PC 2 (S50). Then, according to a command (printing request) for executing the printing on the printer driver, the job data and the first mode information are transmitted and the first mode information is received by the mode information conversion device 10 (S51).

In the mode information conversion device 10, the second mode information for the first image forming device 3 which is related to the first mode information is read based on the mode information management table as shown in FIG. 3, whereby the first mode information is converted to the second mode information (S52). Then, the converted second mode information is transmitted from the mode information conversion device 10 to the first image forming device 3 as the command to execute the printing (printing request), and the second mode information is received by the first image forming device 3 (S53). The first image forming device 3 prints the job data under the various kinds of printing conditions set based on the second mode information.

In addition, in this mode information conversion process, mode information which is not registered in the mode information management table (the number of copies, for example) is not converted in the mode information conversion device 10 and it is received by the image forming device 3 as it is.

Figure 5:
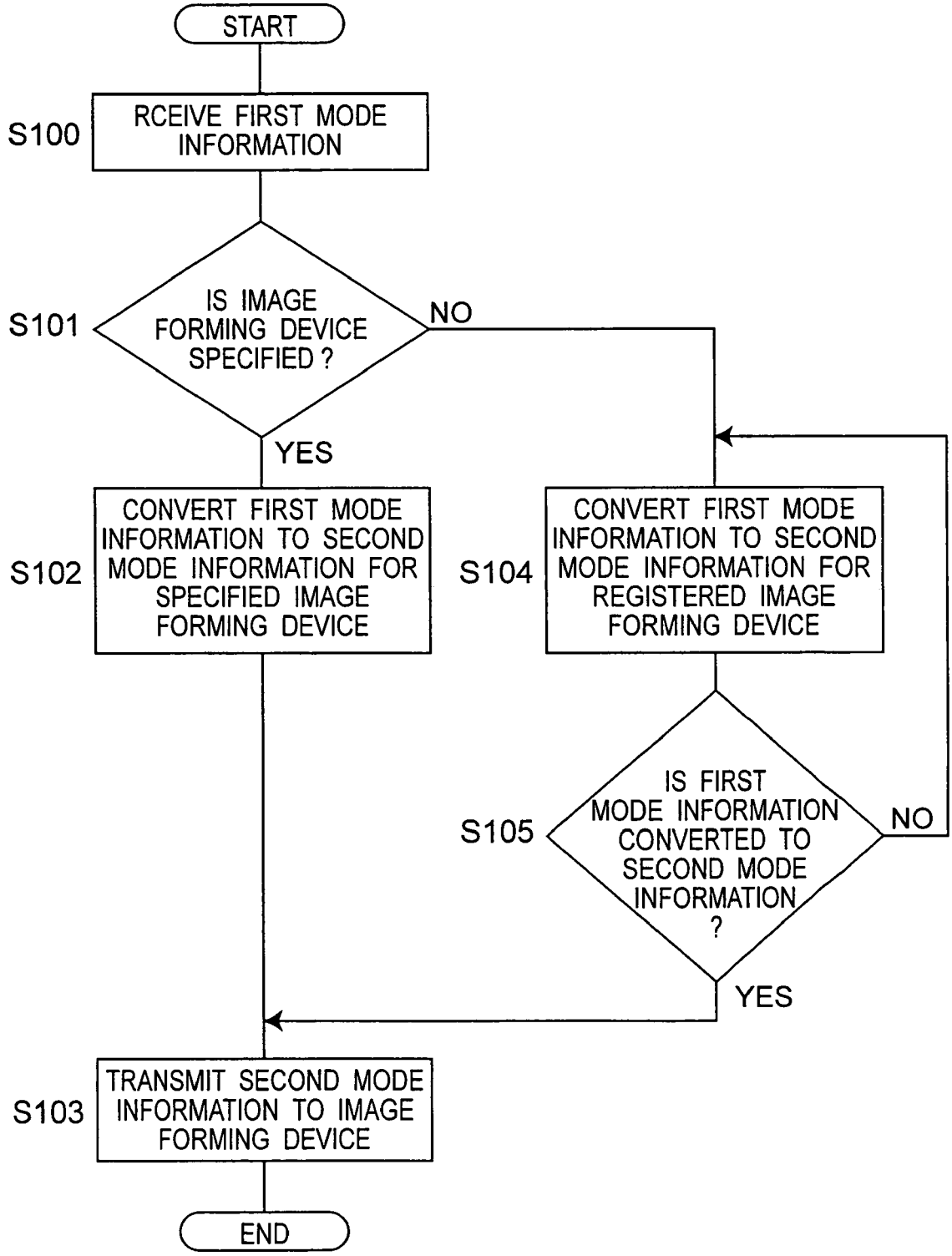
FIG. 5 is a flowchart showing the mode information conversion process executed by the mode information conversion device.

FIG. 5 is a flowchart showing the mode information conversion process carried out by the mode information conversion device 10. In this process, the first mode information transmitted from the client PC 2 when the printing is requested by the user is received (S100). Then, it is determined whether an image forming device is specified as a print output destination or not (S101). When it is determined that the image forming device is specified, the second mode information about the specified image forming device which is registered so as to be related to the first mode information is read and the first mode information is converted to the second mode information (S102). Then, the operation proceeds to S103.

Meanwhile, when it is determined that the image forming device is not specified at S101, the second mode information about any one of previously registered image forming device, which is registered so as to be related to the first mode information is read and the first mode information is converted to the second mode information (S104). Then, it is determined whether the conversion from the first mode information to the second mode information is completed or not (S105). According to this embodiment, the first image forming device 3 does not have a stapling function, for example, so that the second mode information about the first image forming device 3 corresponding to the first mode information "Staple" is not registered in the mode information management table shown in FIG. 3. In this case, the mode information conversion process is not completed at S104. When it is determined that the conversion is not completed at S105, the operation returns to S104 and the subsequent steps are repeated regarding another image forming device. On the other hand, when it is determined that the conversion is completed at S105, the operation proceeds to S103. The converted second mode information is transmitted to the corresponding image forming device at S103. Thus, this process is completed.

When the image forming device as the print output destination is not specified and the image forming device is selected at S104, the priority may be previously registered to select the image forming device based on that priority, or the image forming device used at the previous printing may be selected by priority. Although operations referring to information about a connection state of the image forming device, a mounting state of an option to the image forming device and a sheet feeding place are omitted in the flowchart shown in FIG. 5 in order to simplify the description, if a defect which cannot satisfy the user request occurs in the referring operation, an alarm may be sent to the client PC 2 from which the first mode information is transmitted. Furthermore, the state of each image forming device or option may be determined from the information of the MIB by using the SNMP in the referring operations.

In addition, in the case of the mode information management table shown in FIG. 3, "Super Paper (100 g/m$^2$)" and "Normal Paper (64 g/m$^2$)" in the first mode information are both converted to the second mode information "Standard Paper" in the second image forming device 4. When the second image forming device 4 is specified as the print output destination, an alarm notice to specify a sheet feeding place may be sent to the client PC 2 from which the first mode information is sent at this time. Alternatively, when the image forming device as the print output destination is not specified, the mode information conversion process is performed on the image forming devices except for the second image forming device 4 at this time.

According to this embodiment, when a state which cannot execute the user request regarding the second mode information such as paper out or paper jam occurs while each of the first, second and third image forming devices 3, 4 and 5 performs the printing operation, the mode information conversion device 10 receives the second mode information transmitted from the image forming devices 3, 4 and 5, and converts it to the corresponding first mode information, and then transmits it to the client PC 2 which commanded the printing so that the client PC 2 can take notice of the alarm.

Figure 6:
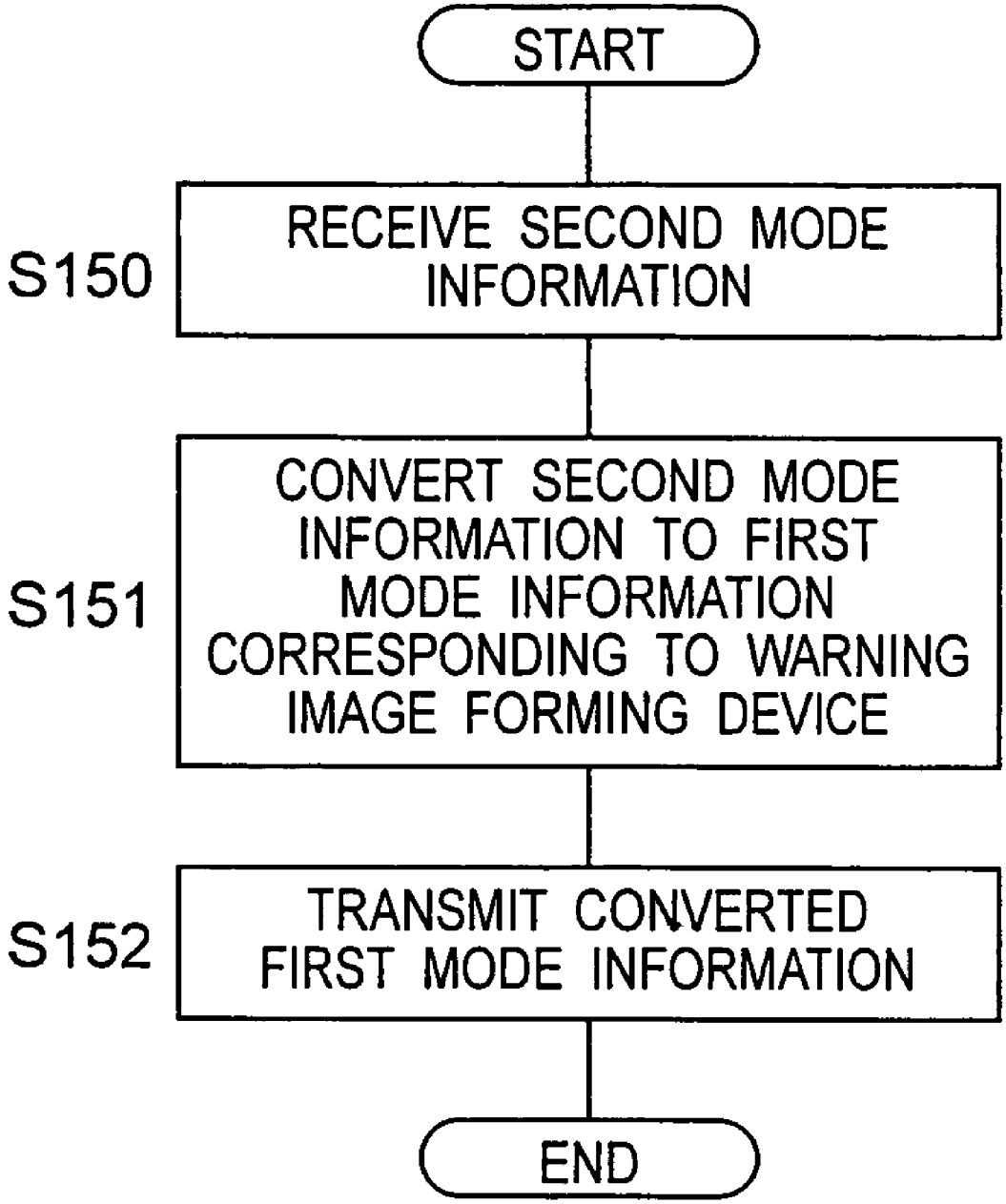
FIG. 6 is a flowchart showing a mode information management process executed by the mode information conversion device when a state which cannot carry out a user request on the side of the image forming device.

FIG. 6 is a flowchart showing a mode information conversion process executed by the mode information conversion device 10 when a state which cannot carry out the user request on the side of the image forming device. In this process, when the state which cannot carry out the user request on the side of the image forming device occurs, the second mode information is received which was transmitted from the image forming device (S150). Then, the first mode information corresponding to the second mode information transmitted from the image forming device is read from the mode information management table shown in FIG. 3, and thus the second mode information is converted to the first mode information (S151). Then, the converted first mode information is transmitted to the client PC 2 which commanded the printing (S152).

The contents of the first mode information transmitted from the mode information conversion device 10 by the mode information conversion process are displayed on the side of the client PC 2, and the defect on the side of the image forming device can be solved in an early stage by impelling a user to supply or remove the sheet, for example. In addition, when the state which cannot carry out the user request is generated in the image forming device, instead of displaying the contents of the first mode information on the side of the client PC 2, the contents of the second mode information corresponding to the first mode information may be displayed on the side of the image forming device for impelling a user to supply or remove the sheet. Thus, the defect on the side of the image forming device can be surely solved in an early stage.

As described above, one or more image forming devices can be set as output destinations of the job data on the printer driver of the client PC 2 when the printing command is issued, and when the plurality of image forming devices are set, the tandem printing is executed. In this case, the plurality of second mode information corresponding to respective image forming devices are obtained from the first mode information in the mode information conversion device 10.

Figure 7:
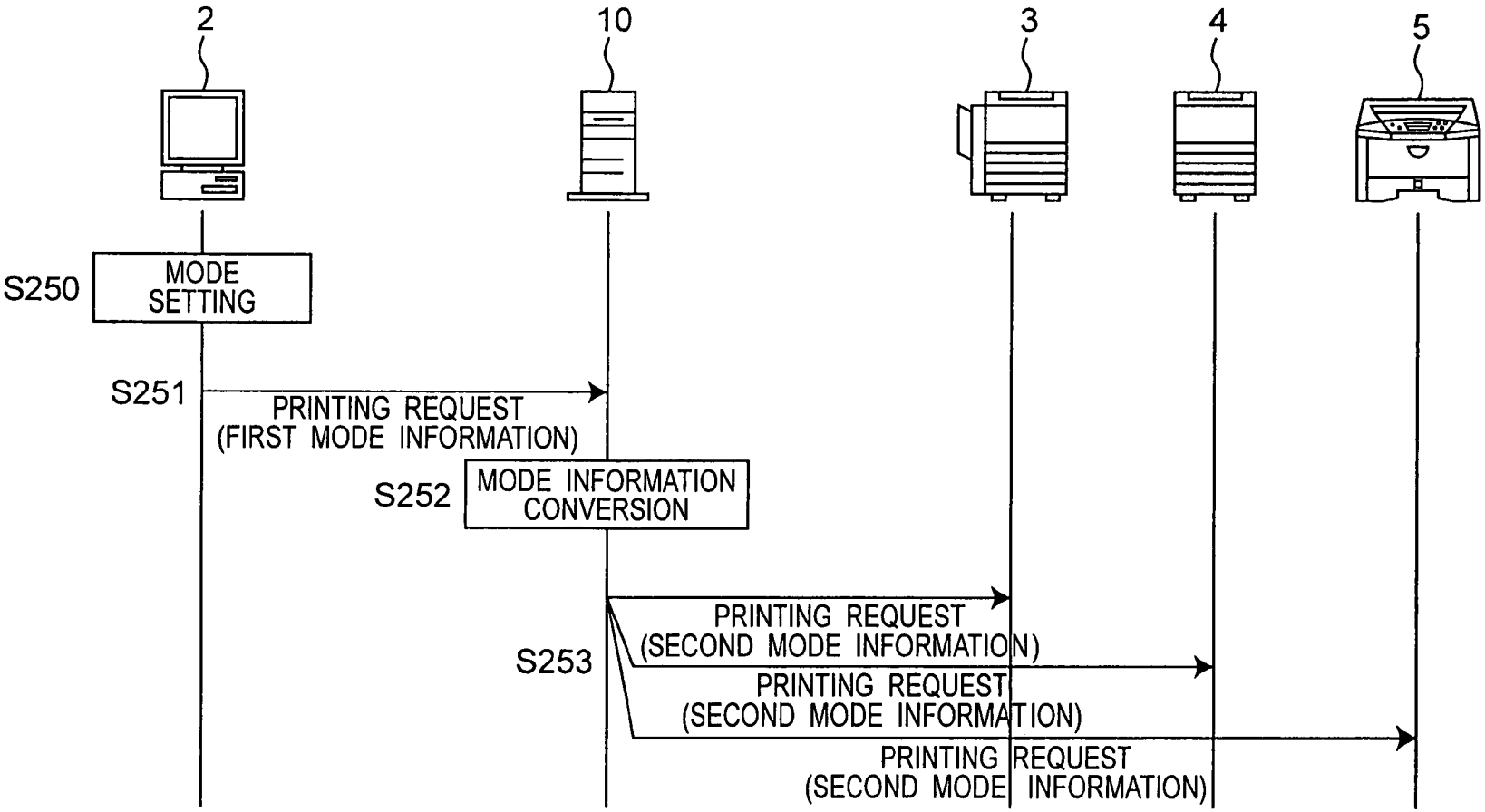
FIG. 7 is a view showing a flow of a mode information conversion process at the time of tandem printing using the mode information conversion device in the image forming system.

FIG. 7 is a view showing a flow of a mode information conversion process at the time of tandem printing using the mode information conversion device 10 in the image forming system 1. Mode setting is performed based on the first mode information showing the various kinds of printing conditions on the printer driver of the client PC 2 (S250). Here, the first, second and third image forming devices 3, 4 and 5 are set as the print output destinations. Then, the job data and the first mode information are transmitted when a command (printing request) for printing execution is issued on the printer driver, and the first mode information is received by the mode information conversion device 10 (S251).

The first mode information is converted to the second mode information by reading the second mode information related to the first mode information for each of the first, second and third image forming devices 3, 4 and 5, based on the mode information management table as shown in FIG. 3, in the mode information conversion device 10 (S252). Then, the converted second mode information is transmitted from the mode information conversion device 10 to the first, second and third image forming devices 3, 4 and 5 as the command of printing execution (printing request) and the second mode information is received by each of the first, second and third image forming devices 3, 4 and 5 (S253). Then, each of the image forming devices 3, 4 and 5 prints out the job data under the various printing conditions set based on the second mode information.

In addition, in this mode information conversion process, the mode information which is not registered in the mode information management table (the number of copies, for example) is not converted in the mode information conversion device 10 and it is received by the image forming devices 3, 4 and 5 as it is.

Figure 8:
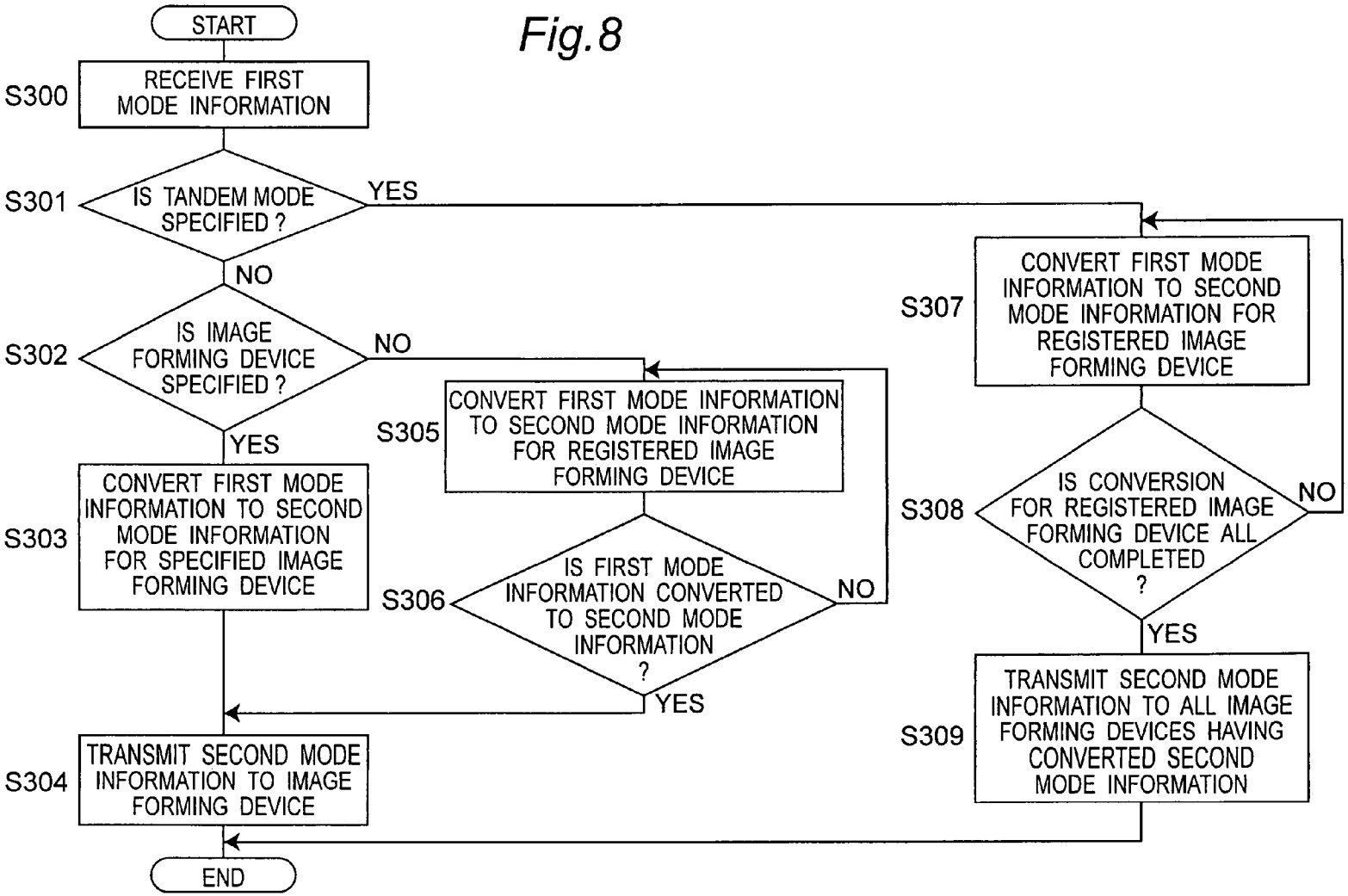
FIG. 8 is a flowchart showing the mode information conversion process executed by the mode information conversion device at the time of the tandem printing.

FIG. 8 is a flowchart of the mode information conversion process executed by the mode information conversion device 10 at the time of tandem printing. In this process, the first mode information which is transmitted from the client PC 2 when the printing request is made by the user (S300) is received. Then, it is determined whether a tandem mode for executing the tandem printing is specified or not (S301). When it is determined that the tandem mode is not specified, the operation proceeds to S302, and when it is determined that the tandem mode is specified, the operation proceeds to S307.

When it is determined that the tandem mode is not specified at S301, it is determined whether the image forming device is specified as the print output destination or not (S302). When it is determined that the image forming device is specified, the first mode information is converted to the second mode information about the specified image forming device by reading the second mode information registered so as to be related to the first mode information (S303). Then, the operation proceeds to S304.

Meanwhile, when it is determined that the image forming device is not specified at S302, the first mode information is converted to the second mode information by reading the second mode information registered so as to be related to the first mode information about any one of previously registered image forming devices (S305). Then, it is determined whether conversion from the first mode information to the second mode information is completed or not (S306). When it is determined that the conversion is not completed yet, the operation returns to S305 and subsequent steps are repeated about another image forming device. Meanwhile, when it is determined that the conversion is completed at S306, the operation proceeds to S304. At S304, the converted second mode information is transmitted to the corresponding image forming device. Thus, this process is completed.

Meanwhile, when it is determined that the tandem mode is specified at S301, the first mode information is converted to the second mode information by sequentially reading the second mode information registered so as to be related to the first mode information about the previously registered image forming device (S307). Then, it is determined whether the mode information conversion process about the plurality of previously registered image forming devices is all completed or not (S308). When it is determined that the mode information conversion process is not completed, the operation returns to S307 and subsequent steps are repeated. Meanwhile, when it is determined that the mode information conversion process is all completed, the converted plurality of second mode information are transmitted to the corresponding image forming devices (S309). Thus, this process is completed.

In addition, it is needless to say that the present invention is not limited to the illustrated embodiment, and various kinds of improvement and change in design can be made without departing from the scope of the present invention.

Although the mode information conversion device 10 is separately provided from the client PC 2 and the image forming devices 3, 4 and 5 in the above embodiment, the present invention is not limited to this, and the mode information conversion device 10 may be constituted as a part of the image forming device, for example to simplify the constitution. That is, any one of the image forming devices 3, 4 and 5 may comprise the mode information conversion function.

Although, in the above embodiment, the description has been made of the case where the source of the job data and the first mode information is the client PC 2, the present invention is not limited to this, and any one of the image forming devices can be the source of the job data and the first mode information. More specifically, the first image forming device 3 may comprise a scanner for creating job data based on an original manuscript, for example, and when it has a function which performs the printing based on the job data and at the same time, instructs other image forming devices (the second and third image forming devices 4 and 5) to perform the printing based on the job data created by the scanner (so-called tandem copying function), the image forming device can be the source of the job data and the first mode information. In this case, the mode information conversion device 10 receives the job data and the second mode information from the first image forming device 3 comprising the scanner, converts the second mode information to second mode information about the second and third image forming devices 4 and 5 related to common first mode information and then, transmits the job data and the second mode information to the second and third image forming devices 4 and 5.

What is claimed is:

1. A mode information conversion device connected to a terminal and an image forming device which performs a printing operation based on predetermined job data such that data can be transmitted and received among them, comprising:

a first receiving unit for receiving first mode information transmitted from the terminal, in which a user request to the image forming device is reflected;

an acquiring unit for acquiring second mode information to be peculiarly used in the image forming device;

a mode information registering unit for registering the first and second mode information so as to be previously related to each other;

a first mode information converting unit for converting the first mode information to the second mode information by reading the second mode information related to the first mode information on the mode information registering unit when the first mode information is received; and a first transmitting unit for transmitting the second mode information acquired by conversion of the first mode information to the image forming device which is a print output destination based on the user request.

2. The mode information conversion device according to claim 1, wherein the mode information registering unit registers the second mode information peculiar to each of the plurality of image forming devices respectively, so as to be related to the first mode information.

3. The mode information conversion device according to claim 1, further comprising:

a second receiving unit for receiving the second mode information transmitted from the image forming device when a state which cannot carry out a user request regarding the second mode information in the image forming device occurs;

a second mode information converting unit for converting the second mode information to the first mode information by reading the first mode information related to the second mode information on the registering unit when the second mode information is received; and a second transmitting unit for transmitting the first mode information acquired by conversion of the first mode information to the terminal.

4. The mode information conversion device according to claim 1, wherein the first and second mode information comprise information for specifying a sheet type.

5. The mode information conversion device according to claim 1, wherein the first and second mode information comprise information for specifying a sheet size.

6. The mode information conversion device according to claim 1, wherein the first and second mode information comprises information for specifying a function setting condition to be used in the image forming device.

7. An image forming device connected to a terminal such that data can be transmitted and received between them and performing a printing operation based on predetermined job data, wherein the mode information conversion device according to claim 1 is constituted as a part of the image forming device.

8. An image forming system in which a terminal and an image forming device which performs a printing operation based on predetermined job data are connected to each other such that data can be transmitted and received among them, said image forming system is provided with a mode information conversion device comprising:

a first receiving unit for receiving first mode information transmitted from the terminal, in which a user request to the image forming device is reflected;

an acquiring unit for acquiring second mode information to be peculiarly used in the image forming device;

a mode information registering unit for registering the first and second mode information so as to be previously related to each other;

a first mode information converting unit for converting the first mode information to the second mode information by reading the second mode information related to the first mode information on the mode information registering unit when the first mode information is received; and a first transmitting unit for transmitting the second mode information acquired by conversion of the first mode information to the image forming device which is a print output destination based on the user request.

9. The image forming system according to claim 8, wherein image forming devices are connected to the terminal and the mode information conversion device such that data can be transmitted and received among them, and the terminal comprises setting unit for setting the plurality of image forming devices as print output destinations, and the mode information conversion device converts the first mode information received from the terminal to the plurality of second mode information related to the first mode information, when the plurality of image forming devices are set by the terminal as the print output destinations, and transmits the second mode information to the plurality of image forming devices as the print output destinations.

10. The image forming system according to claim 8, wherein the mode information conversion device further comprises:

a second receiving unit for receiving the second mode information transmitted from the image forming device when a state which cannot carry out a user request regarding the second mode information in the respective image forming devices occurs;

a second mode information converting unit for converting the second mode information to the first mode information by reading the first mode information related to the second mode information on the registering unit when the second mode information is received; and a second transmitting unit for transmitting the first mode information acquired by conversion of the second mode information to the terminal.

11. The image forming system according to claim 8, wherein the mode information conversion device is constituted as a part of any one of the image forming devices.

12. The image forming system according to claim 8, wherein the first and second mode information comprise information for specifying a sheet type.

13. The image forming system according to claim 8, wherein the first and second mode information comprise information for specifying a sheet size.

14. The image forming system according to claim 8, wherein the first and second mode information comprises information for specifying a function setting condition to be used in the respective image forming devices.

15. The image forming system according to claim 9, wherein at least one image forming device comprises a scanning unit for creating job data based on an original manuscript and has a function of instructing another image forming device to print out based on the job data created by the scanning unit, and the mode information conversion device receives the second mode information from the image forming device comprising the scanning unit, converts the second mode information to second mode information related to common first mode information regarding another image forming device and then, transmits the second mode information to another image forming device when the printout based on the job data created by the scanning unit is instructed.

16. A method of converting mode information between a terminal and an image forming device which performs a printing operation based on predetermined job data, the method comprising steps of:

receiving first mode information transmitted from the terminal, in which a user request to the image forming device is reflected;

acquiring second mode information to be peculiarly used in the image forming device;

registering the first and second mode information so as to be previously related to each other;

converting the first mode information to the second mode information by reading the second mode information related to the first mode information when the first mode information is received; and transmitting the second mode information acquired by conversion of the first mode information to the image forming device which is a print output destination based on the user request.

17. A computer program product for use in a mode information conversion device connected to a terminal and an image forming device which performs a printing operation based on predetermined job data such that data can be transmitted and received among them, the computer program product includes codes on a computer readable medium, comprising:

a code for receiving first mode information transmitted from the terminal, in which a user request to the image forming device is reflected;

a code for acquiring second mode information to be peculiarly used in the image forming device;

a code for registering the first and second mode information so as to be previously related to each other;

a code for converting the first mode information to the second mode information by reading the second mode information related to the first mode information on the mode information registering unit when the first mode information is received; and a code for transmitting the second mode information acquired by conversion of the first mode information to the image forming device which is a print output destination based on the user request.

18. A computer-readable recording medium storing a program for converting mode information in a mode information conversion device connected to a terminal and an image forming device which performs a printing operation based on predetermined job data such that data can be transmitted and received among them, the computer program product includes codes on a computer readable medium, the mode information conversion program including the following steps to be executed by the computer:

a step for receiving first mode information transmitted from the terminal, in which a user request to the image forming device is reflected;

a step for acquiring second mode information to be peculiarly used in the image forming device;

a step for registering the first and second mode information so as to be previously related to each other;

a step for converting the first mode information to the second mode information by reading the second mode information related to the first mode information on the mode information registering unit when the first mode information is received; and a step for transmitting the second mode information acquired by conversion of the first mode information to the image forming device which is a print output destination based on the user request.

* * * * *